US010738722B2

(12) United States Patent
Wodausch et al.

(10) Patent No.: US 10,738,722 B2
(45) Date of Patent: Aug. 11, 2020

(54) METHOD FOR OPERATING A DRIVE SYSTEM OF A MOTOR VEHICLE, DRIVE SYSTEM AND MOTOR VEHICLE

(71) Applicant: VOLKSWAGEN AKTIENGESELLSCHAFT, Wolfsburg (DE)

(72) Inventors: Jens Wodausch, Braunschweig (DE); Björn Fröhlich, Gifhorn (DE); Silke Weddig, Braunschweig (DE); Michael Brand, Wolfsburg (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/420,941

(22) Filed: May 23, 2019

(65) Prior Publication Data

US 2019/0360408 A1 Nov. 28, 2019

(30) Foreign Application Priority Data

May 24, 2018 (DE) ..... 10 2018 112 487

(51) Int. Cl.
*F02D 41/00* (2006.01)
*F02M 25/08* (2006.01)
*F02D 19/06* (2006.01)

(52) U.S. Cl.
CPC ..... *F02D 41/0045* (2013.01); *F02D 19/0621* (2013.01); *F02D 41/003* (2013.01);
(Continued)

(58) Field of Classification Search
CPC ..... F02D 41/0045; F02D 41/003; F02D 41/0032; F02D 41/004; F02D 19/0621; F02M 25/0836; F02M 25/0872
(Continued)

(56) References Cited

U.S. PATENT DOCUMENTS 5,072,712 A 12/1991 Steinbrenner et al.
5,746,187 A * 5/1998 Ninomiya ..... F02D 41/0032 123/520
(Continued)

FOREIGN PATENT DOCUMENTS

DE 38 13220 A1 11/1989
DE 197 01 353 C1 3/1998
(Continued)

OTHER PUBLICATIONS

Extended European search report for European Patent Application No. 19167889.5, dated Oct. 9, 2019.
(Continued)

*Primary Examiner* — Mahmoud Gimie
(74) *Attorney, Agent, or Firm* — Pearl Cohen Zedek Latzer Baratz LLP

(57) ABSTRACT

A method for operating a drive system of a motor vehicle having a combustion engine, a fuel tank, and an evaporative emission control system, includes the following steps: opening a canister-purge valve of the evaporative emission control system; using a first sensor of the motor vehicle designed as a pressure sensor to ascertain an evaporative emission control system pressure prevailing in the evaporative emission control system between a filter device of the evaporative emission control system and the canister-purge valve; using a measurement device of the motor vehicle to ascertain an ambient pressure of the motor vehicle; using a computational device of the motor vehicle to compute a flow volume of a fluid streaming through the canister-purge valve on the basis of the ascertained evaporative emission control system pressure and the ascertained ambient pressure; and using an engine control device of the drive system of the motor vehicle to operate the drive system taking into account the computed fluid flow volume.

10 Claims, 3 Drawing Sheets

(52) U.S. Cl.
CPC ..... *F02D 41/004* (2013.01); *F02D 41/0032* (2013.01); *F02M 25/0836* (2013.01); *F02M 25/0872* (2013.01)

(58) Field of Classification Search
USPC ..... 701/102; 123/516, 518–520
See application file for complete search history.

(56) References Cited

U.S. PATENT DOCUMENTS

| | | | | |
|---|---|---|---|---|
| 5,988,151 | A | 11/1999 | Schneider | |
| 2002/0170550 | A1 | 11/2002 | Mitsutani | |
| 2003/0029226 | A1* | 2/2003 | Kawano | F02M 25/0809 73/40.5 R |
| 2008/0236551 | A1 | 10/2008 | Althof et al. | |
| 2008/0245347 | A1* | 10/2008 | Collet | F02D 41/18 123/520 |
| 2009/0000603 | A1* | 1/2009 | Takakura | F02D 41/0042 123/520 |
| 2013/0213366 | A1 | 8/2013 | Weigl | |
| 2014/0345574 | A1 | 11/2014 | Haefele | |
| 2017/0159588 | A1 | 6/2017 | Honjo | |

FOREIGN PATENT DOCUMENTS

| | | | |
|---|---|---|---|
| DE | 199 59 660 | C1 | 7/2001 |
| DE | 103 35 902 | A1 | 2/2005 |
| DE | 10 2007 013 993 | B4 | 12/2011 |
| DE | 10 2011 084 403 | A1 | 4/2013 |
| DE | 10 2012 220 777 | A1 | 5/2014 |
| DE | 10 2016 014 461 | A1 | 6/2017 |
| DE | 10 2016 122 413 | A1 | 6/2017 |
| EP | 2 627 889 | B1 | 8/2013 |

OTHER PUBLICATIONS

Search report for German Patent Application No. 10 2018 112 487.2, dated Oct. 1, 2018.

* cited by examiner

METHOD FOR OPERATING A DRIVE SYSTEM OF A MOTOR VEHICLE, DRIVE SYSTEM AND MOTOR VEHICLE

CROSS REFERENCE TO RELATED APPLICATIONS

This application claims priority from German Patent Application No. 10 2018 112 487.2, filed May 24, 2018, which is hereby incorporated by reference.

FIELD OF THE INVENTION

The present invention relates to a method for operating a drive system of a motor vehicle. The present invention also relates to a drive system for a motor vehicle, as well as to a motor vehicle having a drive system.

SUMMARY OF THE INVENTION

To operate the combustion engine, motor vehicles equipped therewith have a fuel tank to receive liquid fuel. In a fuel tank filled with liquid fuel, a first partial region has the liquid fuel. A small proportion of the liquid fuel evaporates, so that a second partial region of the fuel tank is filled with gaseous fuel. For this reason, present-day motor vehicles equipped with a combustion engine often have an evaporative emission control system for directing the gaseous fuel out of the fuel tank, as well as for delivering the gaseous fuel to the combustion engine.

Two variants of evaporative emission control systems are generally known. In a first variant, the gaseous fuel is conveyed out of the fuel tank by an electric scavenge pump, mixed with filtered fresh air, and fed into an intake tract of the motor vehicle. Evaporative emission control systems of this kind have a relatively complex design and require significant outlay for control, as well as expensive safety devices to provide protection in a crash situation and are, therefore, relatively cost-intensive. In a second variant, evaporative emission control systems are equipped with a canister-purge valve that can be controlled by a control device, for example, by the engine control device. In response to a partial vacuum prevailing in the intake tract of the motor vehicle and the canister-purge valve being open, gaseous fuel can be removed by suction from the fuel tank, mixed with filtered fresh air, and fed into the intake tract. Evaporative emission control systems of this kind are less complex and, therefore, more economical to manufacture, maintain and service. Nevertheless, they have the inherent disadvantage that only an inaccurate determination of a flow volume of the fluid fed through the canister-purge valve is possible.

This inaccuracy is based, in particular on manufacturing tolerances of components of the evaporative emission control system, in particular of the canister-purge valve, which are also referred to as component variances. Component variances in the evaporative emission control system cause inaccuracies in the supplied air mass, as well as in the supplied fuel mass. This results in inaccuracies in the mixture formation for the combustion engine. An inaccurate mixture formation negatively affects the quality of the lambda control, so that a combustion in the combustion engine deviates from a defined combustion. This can negatively affect performance, efficiency and the pollutant emissions of the combustion engine. Regular tightening of regulatory requirements puts automobile manufacturers under increased pressure to continuously reduce pollutant emissions and the fuel consumption of combustion engines.

The European Patent EP 2 627 889 B1 describes a method and a device for operating an evaporative emission control system. The evaporative emission control system is designed in accordance with the first variant and thus includes a scavenge pump. A density of the purge air can be determined on the basis of a pump characteristic of the scavenge pump. This device has the disadvantage that deviations in the scavenge pump from the pump characteristic due to manufacturing tolerances are not considered. Moreover, a device of this kind is very complex in design and thus expensive to manufacture. The German Examined Application DE 10 2007 013 993 B4 describes a control method for a combustion engine. In accordance with the control method, conclusions about the supplied fuel quantity are drawn from data on the exhaust gas obtained from a lambda control. The disadvantage here is that an optimized combustion always entails a delay and requires constant correction by the lambda control. The German Patent Application DE 10 2012 220 777 A1 relates to an evaporative emission control system having a canister-purge valve and a bypass valve for increasing the purge air flow rate. This evaporative emission control system also does not take manufacturing tolerances of the canister-purge valve nor of the bypass valve into consideration, so that it is also not possible to accurately determine the purge air flow rate.

It is, therefore, an object of the present invention to overcome or at least partially overcome the above discussed disadvantages in a method for operating a drive system of a motor vehicle, a drive system for a motor vehicle, as well as in a motor vehicle having a drive system. In particular, it is an object of the present invention to provide a method, a drive system and a motor vehicle that will readily and cost-effectively ensure an improved control of the flow volume of the fluid streaming through the canister-purge valve.

SUMMARY OF THE INVENTION

The aforementioned objective is achieved by the claims. Accordingly, the object is achieved by a method for operating a drive system of a motor vehicle, by a drive system for a motor vehicle, as well as by a motor vehicle having a drive system of the independent claims. Other features of the present invention and details pertaining thereto are derived from the dependent claims, the Specification and the drawings. It is thereby self-evident that features and details described in connection with the method of the present invention, also apply in connection with the drive system of the present invention, as well as with the motor vehicle of the present invention, and, respectively, vice versa, so that the disclosure of the particular inventive aspects will or may always be referred to reciprocally.

In accordance with a first aspect of the present invention, the objective is achieved by a method for operating a drive system of a motor vehicle. The drive system has a combustion engine, a fuel tank and an evaporative emission control system. The method includes the following steps:

- opening a canister-purge valve of the evaporative emission control system;
- using a first sensor of the motor vehicle designed as a pressure sensor to ascertain an evaporative emission control system pressure prevailing in the evaporative emission control system between a filter device of the evaporative emission control system and the canister-purge valve;

using a measurement device of the motor vehicle to determine an ambient pressure of the motor vehicle;

using a computational device of the motor vehicle to compute a flow volume of a fluid streaming through the canister-purge valve on the basis of the ascertained evaporative emission control system pressure and the ascertained ambient pressure; and using an engine control device of the drive system of the motor vehicle to operate the drive system taking into account the computed fluid flow volume.

The evaporative emission control system preferably has a vent line which is coupled to the fuel tank in fluid communication therewith in order to vent the same. The vent line is preferably coupled to a region of the fuel tank in fluid communication therewith, which, even in the case of a completely filled fuel tank, is located outside of the liquid fuel, thereby ensuring a normal operational ventilation of the fuel tank. Accordingly, the vent line is preferably coupled to the fuel tank in fluid communication therewith at a top side thereof. The vent line preferably leads into a filter device of the evaporative emission control system and is coupled thereto in fluid communication therewith. The filter device preferably has an activated-carbon filter. It is also preferred that the evaporative emission control system have an air supply line, which is coupled to the filter device in fluid communication therewith and is designed for supplying ambient air thereinto. The ambient air, as well as the fluid conveyed out of the fuel tank may thus be intermixed in the filter device. The filter device is designed to filter at least the fresh air supplied through the air supply line. A fluid supply line leads from the filter device to the intake tract of the combustion engine and is coupled thereto in fluid communication therewith. Moreover, between the filter device and the intake tract, the canister-purge valve of the evaporative emission control system is coupled to the fluid supply line in fluid communication therewith in a way that enables the canister-purge valve to restrict and preferably shut off a flow volume of fluid streaming through the fluid supply line.

Upon implementation of the inventive method, the canister-purge valve is opened, thereby allowing a flow volume of fluid to stream through the canister-purge valve, as well as through the fluid supply line, into the intake tract of the combustion engine. A volumetric fluid flow rate is particularly a function of a partial vacuum prevailing in the intake tract, as well as of a valve position of the canister-purge valve.

The evaporative emission control system pressure prevailing in the evaporative emission control system between the filter device of the evaporative emission control system and the canister-purge valve is subsequently ascertained. A first sensor of the motor vehicle, which is designed as a pressure sensor, ascertains the evaporative emission control system pressure. Accordingly, the first sensor is located between the filter device and the canister-purge valve, for example, on the fluid supply line, and designed to measure the evaporative emission control system pressure prevailing within the fluid supply line. The first sensor is preferably coupled to the fluid supply line in fluid communication therewith. It is also preferred that the first sensor be configured directly or immediately upstream of the canister-purge valve or be integrated therein in a way that enables it to determine the evaporative emission control system pressure prevailing on a fuel tank side of the canister-purge valve. Here the advantage is derived that the number of parts of the motor vehicle is reduced. A final assembly is thus facilitated. The evaporative emission control system pressure is preferably ascertained continually, in order to immediately record any change therein. In accordance with the present invention, it may also be provided that the evaporative emission control system pressure be applied at time intervals or intermittently, ascertainment intervals preferably being selected in a way that allows changes in evaporative emission control system pressure to be ascertained within a predefined tolerance. This prevents changes in evaporative emission control system pressure from being recorded too late and the combustion engine from being consequently operated with incorrect operating parameters.

The ambient pressure of the motor vehicle is ascertained by the measurement device thereof. The ascertainment may be made, for example, by receiving ambient pressure data provided by a central server, in particular a meteorological service. In this case, the measurement device is designed as a receiving device, for example. Alternatively, the measurement device may also be designed for sampling ambient pressure data that are measured by a pressure sensor of the motor vehicle. For this purpose, the measurement device is preferably coupled to a control device and/or to an on-board computer of the motor vehicle. The ambient pressure may be ascertained continually or at time intervals. Since a sudden change in ambient pressure is ordinarily not expected, the time intervals may also be a plurality of seconds in length.

The computational device of the drive train subsequently computes the flow volume of the fluid streaming through the canister-purge valve. The determined evaporative emission control system pressure and the ascertained ambient pressure are used as a basis for the computation. The fluid flow volume is preferably always computed in response to a changed evaporative emission control system pressure and/or a changed ambient pressure being ascertained. A computational outlay may be thereby reduced.

Finally, the drive system is operated by the engine control device of the drive system of the motor vehicle. The computed flow volume of fluid, which corresponds to an actual flow volume of fluid or only deviates minimally therefrom due to measurement inaccuracies, is taken as a basis here. Since the actual flow volume of the fluid streaming from the evaporative emission control system into the intake tract is known at this point, the engine control device is able to control an injected fuel quantity in a way that enables the combustion engine to be operated precisely in accordance with the combustion requirements for operating the same. This is preferably continually checked by a lambda control of the drive system.

An inventive method for operating a drive system of a motor vehicle has the advantage over conventional methods that a fuel quantity supplied to the combustion engine is able to be determined readily and cost-effectively with a substantially greater accuracy, eliminating the need for using the lambda control to readjust the fuel supply. It is thus readily possible to compensate for component variances caused by manufacturing tolerances, in particular of a canister-purge valve. It is thereby possible to improve an efficiency, as well as a performance of the combustion engine. Moreover, more accurately controlling the fuel quantity supplied to the combustion engine makes it possible to reduce the pollutant emissions thereof. The need is also eliminated for using an additional purge air pump in the intake tract to vent the fuel tank, thereby reducing the manufacturing costs of the drive train, as well as of a motor vehicle having the same.

In a method for operating a drive system of a motor vehicle, a preferred embodiment of the present invention provides that a second sensor designed as a pressure sensor be used as the measurement device. The second sensor is preferably located at an area of the motor vehicle where ambient pressure prevails during travel. During motor vehicle travel, preferably no or only slight turbulent flows occur in this area. A second sensor designed as a pressure sensor advantageously makes it possible for the ambient pressure to be determined independently of an external server. Furthermore, the ambient pressure may be determined directly on the motor vehicle, thereby readily and cost-effectively ensuring an especially accurate ascertainment of the ambient pressure in the area of the motor vehicle, in particular in regions having a steep gradient and thus substantial ambient pressure differences.

The present invention prefers that Bernoulli's equation be used to compute the flow volume of the fluid streaming through the canister-purge valve. Within this framework, the fluid flow volume may be determined by an energy balance in accordance with the principle of conservation of energy:

$$\tilde{E}_0=\tilde{E}_1$$

In this computation, the ambient air of the motor vehicle is preferably assumed to be still. Accordingly, the following Bernoulli equation holds for a surrounding area of the motor vehicle:

$$\tilde{E}_0=p_{Umg}+\tfrac{1}{2}\rho_0 v_0 p_{Umg}$$

The Bernoulli equation holds for the area in the evaporative emission control system at the first sensor, thus upstream of the canister-purge valve:

$$\tilde{E}_1=p_{TEV}+\tfrac{1}{2}\rho_1 v_1^2+\tfrac{1}{2}k\rho_1 v_1^2$$

Transposing these equations, the fluid flow volume is obtained in a plurality of steps:

$$p_{Umg}=p_{TEV}+\frac{1}{2}\rho_1 v_1^2+\frac{1}{2}k\rho_1 v_1^2$$

$$p_{Umg}-p_{TEV}=\frac{1}{2}\rho_1 v_1^2+\frac{1}{2}k\rho_1 v_1^2$$

$$\Delta p=\frac{1}{2}(1+k)\rho_1 v_1^2$$

$$\Delta p=\frac{1}{2}(1+k)\rho_1\left(\frac{V}{At}\right)^2$$

$$\Delta p=\frac{1}{2}(1+k)\rho_1\frac{1}{A^2}\left(\frac{V}{t}\right)^2$$

$$\dot{V}^2:=\left(\frac{V}{t}\right)^2=\frac{2A^2\Delta p}{(1+k)\rho_1}$$

$$\dot{V}=\frac{V}{t}=A\sqrt{\frac{2\Delta p}{(1+k)\rho_1}}$$

Thus, the fluid flow volume is able to be readily and reliably determined by Bernoulli's equation.

It is also preferred that a temperature of the fluid flowing through the canister-purge valve be ascertained by a third sensor designed as a temperature sensor, a density of the fluid being determined on the basis of the ascertained temperature; a mass flow of the fluid flowing through the canister-purge valve being computed on the basis of the ascertained volume flow and the determined density; and the drive system being operated by the engine control device taking into account the computed mass flow. Alternatively, the density may be determined using the lambda control of the drive system. By determining the mass flow, a technical parameter is readily and cost-effectively determined, which, as the operating parameter, is especially suited for the engine control device for precisely and reliably controlling the fuel supply for the combustion engine.

In accordance with a second aspect of the present invention, the objective is achieved by a drive system for a motor vehicle. The drive system has a combustion engine, an engine control device and a fuel tank having an evaporative emission control system, as well as a controllable canister-purge valve for venting the fuel tank, and a measurement device for ascertaining an ambient pressure of the motor vehicle. In accordance with the present invention, the drive system has a first sensor designed as a pressure sensor for ascertaining an evaporative emission control system pressure in the evaporative emission control system between a filter device of the evaporative emission control system and the canister-purge valve, as well as a computational device for computing a flow volume of a fluid streaming through the canister-purge valve, on the basis of the ascertained ambient pressure and the ascertained evaporative emission control system pressure.

The combustion engine is preferably in the form of a spark-ignition engine or Diesel engine. The present invention may also provide that the combustion engine be designed for combusting various fuels, in particular a liquid fuel, such as a gasoline or a Diesel fuel, and a gaseous fuel, such as natural gas, for example. The combustion engine has at least one, preferably a plurality of cylinders.

To operate the combustion engine, the engine control device is designed for controlling the combustion engine, in particular a quantity of liquid fuel injected into an intake tract. Taking into account the computed flow volume of the fluid streaming from the evaporative emission control system into the intake tract, the engine control device is designed for controlling the injected fuel quantity in a way that enables the combustion engine to be operated precisely in accordance with the combustion requirements for operating the same.

The drive system preferably has a lambda control in order to check a combustion process of the combustion engine. Via the lambda control, it is also possible to check the plausibility of fluid flow volumes or of fluid mass flows computed by the computational device. Defective sensors may be hereby ascertained, for example.

The fuel tank is designed for receiving a liquid fuel, for example, a gasoline or a Diesel fuel. The evaporative emission control system preferably has a vent line which is coupled to the fuel tank in fluid communication therewith in order to vent the same. The vent line is preferably coupled to a region of the fuel tank in fluid communication therewith, which, even in the case of a completely filled fuel tank, is located outside of the liquid fuel, thereby ensuring a normal operational ventilation of the fuel tank. Accordingly, the vent line is preferably coupled to the fuel tank in fluid communication therewith at a top side thereof. The vent line preferably leads into a filter device of the evaporative emission control system and is coupled thereto in fluid communication therewith. The filter device preferably has an activated-carbon filter for collecting hydrocarbons from the fuel tank. It is also preferred that the evaporative emission control system have an air supply line, which is coupled to the filter device in fluid communication therewith and is designed for supplying ambient air thereinto. The filter device is preferably further designed to filter the fresh air supplied through the air supply line. The ambient air, as well as the fluid conveyed out of the fuel tank may thus be intermixed in the filter device. The ambient air may be used to purge the filter device in such a way that the hydrocarbons accumulated in the filter device are purged therefrom and mixed with the ambient air. A fluid supply line leads from the filter device to the intake tract of the combustion engine and is coupled thereto in fluid communication therewith. Moreover, between the filter device and the intake tract, the canister-purge valve of the evaporative emission control system is coupled to the fluid supply line in fluid communication therewith in a way that enables the canister-purge valve to restrict and preferably shut off a flow volume of fluid streaming through the fluid supply line.

The first sensor is located between the filter device and the canister-purge valve, for example, on the fluid supply line or the canister-purge valve, and designed to measure the evaporative emission control system pressure prevailing within the fluid supply line. The first sensor is preferably coupled to the fluid supply line in fluid communication therewith. It is also preferred that the first sensor be configured directly or immediately upstream of the canister-purge valve, enabling the evaporative emission control system pressure prevailing on a fuel tank side of the canister-purge valve to be determined by the first sensor.

The ambient pressure of the motor vehicle may be ascertained by the measurement device thereof. For this purpose, the measurement device may be designed as a receiving device, for example, for receiving ambient pressure data provided by a central server, in particular a meteorological service. Alternatively, the measurement device may also be designed for sampling ambient pressure data that are measured by a pressure sensor of the motor vehicle. For this purpose, the measurement device is preferably coupled or couplable to a control device and/or to an on-board computer of the motor vehicle.

The computational device of the drive train is designed for computing the flow volume of the fluid streaming through the canister-purge valve. The computational device is designed for computing the fluid flow volume using the ascertained evaporative emission control system pressure, as well as the ascertained ambient pressure. The present invention may provide that the computational device be designed to be part of the engine control device.

In the described drive system for a motor vehicle, all advantages are derived that were already described for a method for operating a drive system of a motor vehicle in accordance with the first aspect of the present invention. Accordingly, the inventive drive system has the advantage over conventional drive systems that a fuel quantity supplied to the combustion engine is able to be determined readily and cost-effectively with a substantially greater accuracy, eliminating the need for using the lambda control to readjust the fuel supply. It is thus readily possible to compensate for component variances caused by manufacturing tolerances, in particular of a canister-purge valve. It is thereby possible to improve an efficiency, as well as a performance of the combustion engine. Moreover, more accurately controlling the fuel quantity supplied to the combustion engine makes it possible to reduce the pollutant emissions thereof. The need is also eliminated for an additional purge air pump for venting the fuel tank into the intake tract, thereby reducing the manufacturing costs of the drive train, as well as of a motor vehicle having the same.

In an especially preferred embodiment, the drive system is designed for implementing a method. Thus, an especially accurate determination of the fluid flow volume is ensured.

The first sensor is preferably integrated in the canister-purge valve of the evaporative emission control system. Relative to a direction of flow of the fluid, the first sensor is thereby preferably configured on a side of the canister-purge valve facing the fuel tank or the filter device, making it possible to ascertain the evaporative emission control system pressure prevailing on the fuel tank side of the canister-purge valve. Integrating a first sensor in the canister-purge valve has the advantage of making it possible for the canister-purge valve, including the first sensor, to be produced in advance as a subassembly. This reduces the number of parts of the drive system to be assembled in the final assembly, thereby facilitating a final assembly of the drive system.

A preferred specific embodiment of the present invention provides that the measurement device be designed as a second sensor, the second sensor being designed as a pressure sensor. The second sensor may preferably be located at an area of the motor vehicle where ambient pressure prevails during travel. During motor vehicle travel, preferably no or only slight turbulent flows occur in this area. A second sensor designed as a pressure sensor advantageously makes it possible for the ambient pressure to be determined independently of an external server. Furthermore, the ambient pressure may be determined directly on the motor vehicle, thereby readily and cost-effectively ensuring an especially accurate ascertainment of the ambient pressure in the area of the motor vehicle, in particular in regions having a steep gradient and thus substantial ambient pressure differences.

It is especially preferred that the evaporative emission control system have a third sensor designed as a temperature sensor, the first sensor and the third sensor being designed as a common sensor. Here the advantage is derived that a density of the fluid may be determined on the basis of the ascertained temperature. A mass flow of the fluid streaming through the canister-purge valve may be computed on the basis of the ascertained volume flow and the determined density. An optimized operation of the engine control device for operating the internal combustion engine may be ensured on the basis of the computed mass flow. Thus, the additional determinability of the temperature makes it possible to readily and cost-effectively optimize an operation of the drive train. The engine control device is, therefore, able to control a fuel supply for the combustion engine very accurately and reliably.

In accordance with a third aspect of the present invention, the objective is achieved by a motor vehicle having a drive system according to the present invention. The drive system has a combustion engine, an engine control device and a fuel tank having an evaporative emission control system, as well as a controllable canister-purge valve for venting the fuel tank, and a measurement device for ascertaining an ambient pressure of the motor vehicle. In accordance with the present invention, the drive system has a first sensor designed as a pressure sensor for ascertaining an evaporative emission control system pressure in the evaporative emission control system between a filter device of the evaporative emission control system and the canister-purge valve, as well as a computational device for computing a flow volume of a fluid streaming through the canister-purge valve, on the basis of the ascertained ambient pressure and the ascertained evaporative emission control system pressure.

In the case of the described motor vehicle, all advantages are derived that were already described for a method for operating a drive system of a motor vehicle in accordance with the first aspect of the present invention, as well as for a drive system for a motor vehicle in accordance with the second aspect of the present invention. Accordingly, the motor vehicle according to the present invention has the advantage over conventional motor vehicles that a fuel quantity supplied to the combustion engine is able to be determined readily and cost-effectively with a substantially greater accuracy, eliminating the need for using the lambda control to readjust the fuel supply. It is thus readily possible to compensate for component variances caused by manufacturing tolerances, in particular of a canister-purge valve. It is thereby possible to improve an efficiency, as well as a performance of the combustion engine. Moreover, more accurately controlling the fuel quantity supplied to the combustion engine makes it possible to reduce the pollutant emissions thereof. The need is also eliminated for an additional purge air pump for venting the fuel tank into the intake tract, thereby reducing the manufacturing costs of the drive train, as well as of a motor vehicle having the same.

BRIEF DESCRIPTION OF THE DRAWINGS

A method according to the present invention for operating a drive system of a motor vehicle, a drive system according to the present invention for a motor vehicle, as well as a motor vehicle according to the present invention are clarified in greater detail in the following with reference to the drawing. The figures show schematically.

Elements having the same function and mode of operation are provided with the same reference numerals in FIG. 1 through 3.

DETAILED DESCRIPTION OF THE INVENTION

Figure 1:
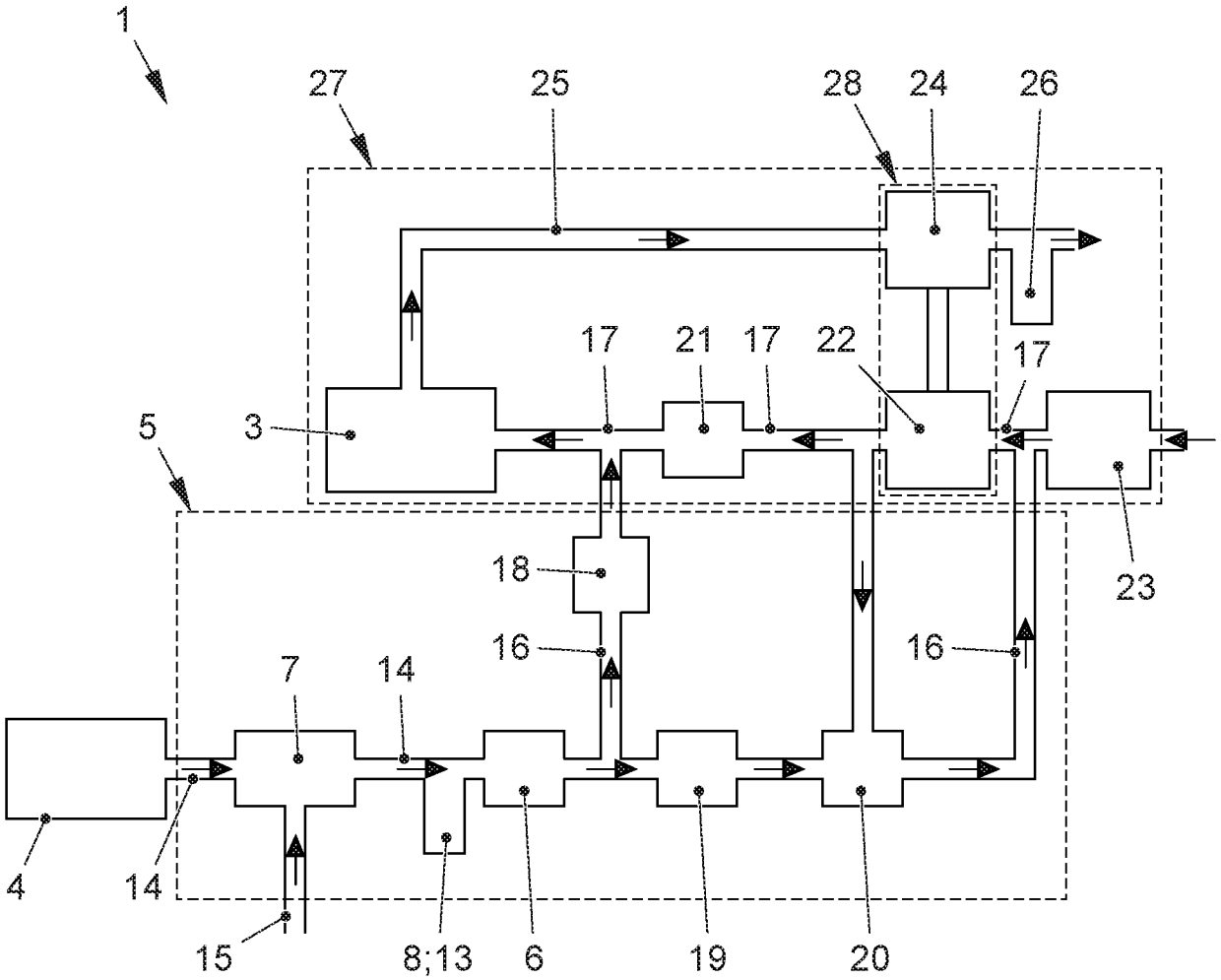
FIG. 1 is a design of a preferred specific embodiment of a drive system according to the present invention.

FIG. 1 schematically illustrates a design of a preferred specific embodiment of a drive system 1 according to the present invention. Drive system 1 includes a combustion engine system 27, a fuel tank 4 and an evaporative emission control system 5.

Combustion engine system 27 has an air filter 23 for filtering induced fresh air. The fresh air may be supplied via an intake pipe 17 into a compressor 22 of an exhaust turbocharger 28 and is compressible there. The fresh air may be supplied to a combustion engine 3 of combustion engine system 27 via intake pipe 17 and a throttle valve 21. The exhaust gases may be directed out of combustion engine 3 via an exhaust line and fed into a turbine 24 of exhaust turbocharger 28 to drive compressor 22. Configured downstream of turbine 24 is a lambda probe for measuring emission levels.

Gaseous fuel may be fed via a vent line 14 of evaporative emission control system 5 from fuel tank 4 into a filter device 7 of evaporative emission control system 5. Via a supply air line 15 of evaporative emission control system 5, ambient air may be fed into filter device 7 and filtered by the same. For this purpose, filter device 7 preferably has an activated-carbon filter. A mixture of gaseous fuel and the filtered ambient air may be produced in filter device 7. The mixture may be fed as a fluid flow volume via vent line 14 through a canister-purge valve 6 of evaporative emission control system 5. A volumetric fluid flow rate is controllable via canister-purge valve 6.

A first sensor 8 designed as a pressure sensor, which, in addition, is designed as third sensor 13 for measuring a temperature of the fluid flow volume, is configured upstream of canister-purge valve 6. In an alternative specific embodiment of the present invention, the need may also be eliminated for third sensor 13, so that only a first sensor 8 is located at this position. Following canister-purge valve 6, a fluid supply line 16 of evaporative emission control system 5 is configured downstream of throttle valve 21 to feed a portion of the fluid flow volume via a first non-return valve into intake pipe 17. In accordance with this preferred exemplary embodiment, evaporative emission control system 5 is also designed to supply the other portion of the fluid flow volume via a fluid supply line 16, as well as via a venturi tube 20 to intake pipe 17 between air filter 23 and compressor 22. A fuel supply device for supplying liquid fuel to intake pipe 17 is preferably provided in accordance with the present invention, but not shown in FIG. 1 for the sake of improved clarity.

Figure 2:
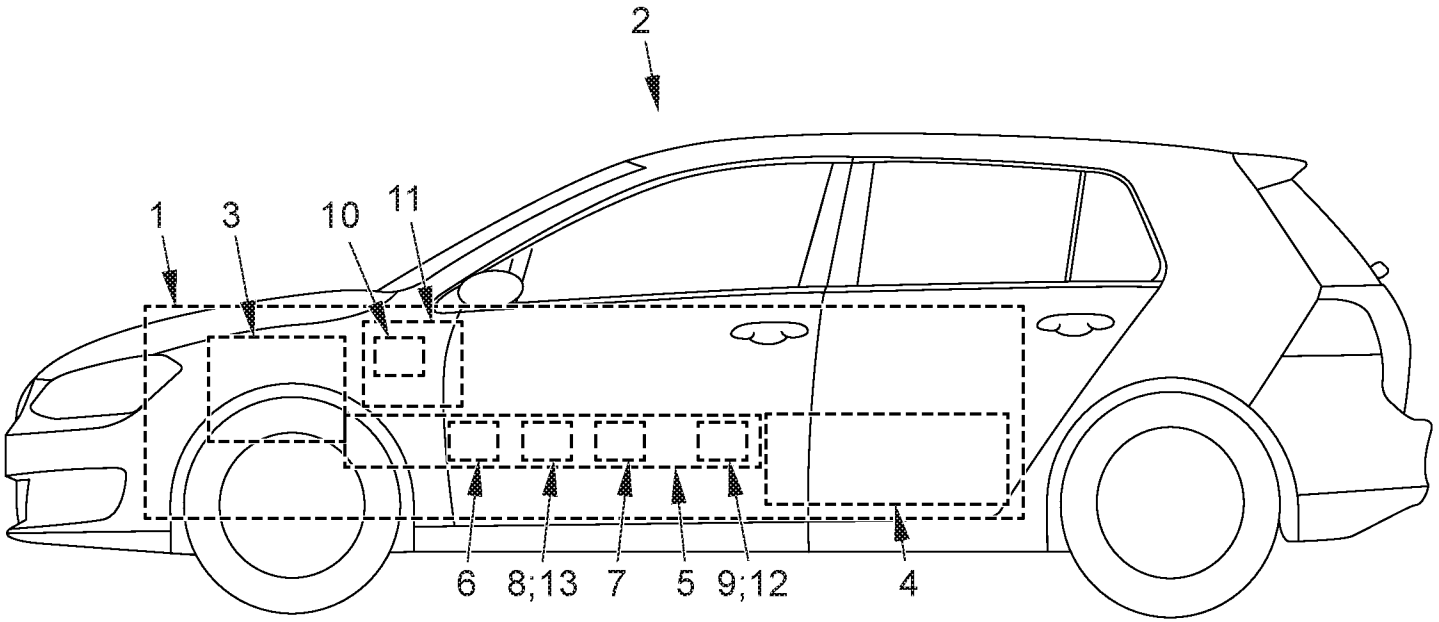
FIG. 2 is a side view of a preferred specific embodiment of a motor vehicle according to the present invention.

FIG. 2 schematically shows a side view of a preferred specific embodiment of a motor vehicle 2 according to the present invention having a drive system 1 according to the present invention. Components of drive system 1 configured inside of motor vehicle 2 are only indicated by dashed lines and, in accordance with the present invention, may also be configured at other locations of the motor vehicle. Drive system 1 includes a combustion engine 3, an engine control device 11, a fuel tank 4, as well as an evaporative emission control system 5. A computational device 10 is designed as part of engine control device 11. A fuel supply device for supplying liquid fuel to intake pipe 17 is preferably provided in accordance with the present invention, but not shown in FIG. 2 for the sake of improved clarity.

Evaporative emission control system 5 has a canister-purge valve 6, a first sensor 8 designed as a pressure sensor, a filter device for filtering induced ambient air and a measurement device 9. First sensor 8 is also designed as third sensor 13 for measuring temperature. In this exemplary embodiment, measurement device 9 is designed as second sensor 12 for measuring pressure.

Figure 3:
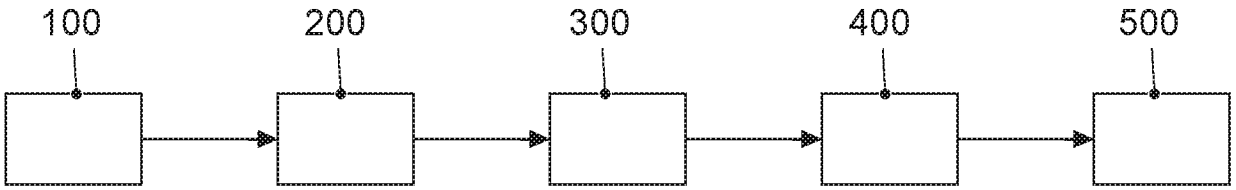
FIG. 3 is a flow chart of a preferred specific embodiment of a method according to the present invention.

In a flow chart, FIG. 3 schematically illustrates a preferred specific embodiment of a method according to the present invention. A canister-purge valve 6 of evaporative emission control system 5 is opened in a first method step 100. The opening may be carried out completely or partially. It is preferably engine control device 11 of inventive drive system 1 of inventive motor vehicle 2 that actuates the opening of canister-purge valve 5. In a second method step 200, an evaporative emission control system pressure prevailing in evaporative emission control system 5 between filter device 7 of evaporative emission control system 5 and canister-purge valve 6 is ascertained by first sensor 8 of motor vehicle 2 that is designed as a pressure sensor. The ascertained evaporative emission control system pressure is preferably transmitted to computational device 10, in particular of engine control device 11. In a third method step 300, the ambient pressure of motor vehicle 2 is ascertained by measurement device 9 of motor vehicle 2. For this, measurement device 9 is preferably designed as second sensor 12, second sensor 12 being designed as a pressure sensor. The ascertained ambient pressure is preferably transmitted to computational device 10, in particular of engine control device 11. In a fourth method step 400, the flow volume of the fluid streaming through canister-purge valve 6 is computed by computational device 10 on the basis of the ascertained evaporative emission control system pressure and the ascertained ambient pressure. The computations are preferably based on a Bernoulli equation, as well as on a principle of conservation of energy. In a fifth method step 500, inventive drive system 1 is operated by engine control device 11, taking the computed fluid flow volume into account. In an alternative embodiment of the method according to the present invention, a temperature of the fluid is ascertained by a third sensor 13 designed as a temperature sensor. For this, first sensor 8 is preferably designed as third sensor 13, thus as a "dual sensor." Engine control device 11 computes a fluid mass flow on the basis of the temperature and the fluid flow volume. Engine control device 11 then uses the fluid mass flow as a basis for operating drive system 1.

REFERENCE NUMERAL LIST

1 drive system
2 motor vehicle
3 combustion engine
4 fuel tank
5 evaporative emission control system
6 canister-purge valve
7 filter device
8 first sensor
9 measurement device
10 computational device
11 engine control device
12 second sensor
13 third sensor
14 vent line
15 supply air line
16 fluid supply line
17 intake pipe
18 first non-return valve
19 second non-return valve
20 venturi tube
21 throttle valve
22 compressor
23 air filter
24 turbine
25 exhaust line
26 lambda probe
27 combustion engine system
28 exhaust turbocharger
100 first method step
200 second method step
300 third method step
400 fourth method step
500 fifth method step

The invention claimed is:

1. A method for operating a drive system of a motor vehicle having a combustion engine, a fuel tank, and an evaporative emission control system, comprising the following steps:

opening a canister-purge valve of the evaporative emission control system;

using a first sensor of the motor vehicle designed as a pressure sensor to ascertain an evaporative emission control system pressure prevailing in the evaporative emission control system between a filter device of the evaporative emission control system and the canister-purge valve;

using a measurement device of the motor vehicle to ascertain an ambient pressure of the motor vehicle;

using a computational device of the motor vehicle to compute a flow volume of a fluid streaming through the canister-purge valve on the basis of the ascertained evaporative emission control system pressure and the ascertained ambient pressure; and using an engine control device of the drive system of the motor vehicle to operate the drive system taking into account the computed fluid flow volume.

2. The method as recited in claim 1, wherein a second sensor designed as a pressure sensor is used as the measurement device.

3. The method as recited in claim 1, wherein Bernoulli's equation is used to compute the flow volume of the fluid streaming through the canister-purge valve.

4. The method as recited in claim 1, wherein:

a temperature of the fluid flowing through the canister-purge valve is ascertained by a third sensor designed as a temperature sensor;

a density of the fluid is determined on the basis of the ascertained temperature;

the mass flow of the fluid streaming through the canister-purge valve is computed on the basis of the ascertained volume flow and the determined density; and the drive system is operated by the engine control device taking into account the computed mass flow.

5. A drive system for a motor vehicle, comprising:

a combustion engine, an engine control device, a fuel tank having an evaporative emission control system, a controllable canister-purge valve for venting the fuel tank, and a measurement device for ascertaining an ambient pressure of the motor vehicle, wherein the drive system has a first sensor designed as a pressure sensor for ascertaining an evaporative emission control system pressure prevailing in the evaporative emission control system between a filter device of the evaporative emission control system and the canister-purge valve, as well as a computational device for computing a flow volume of a fluid streaming through the canister-purge valve on the basis of the ascertained ambient pressure and the ascertained evaporative emission control system pressure.

6. The drive system as recited in claim 5, wherein the drive system is designed for implementing a method comprising the following steps:

opening a canister-purge valve of the evaporative emission control system;

using a first sensor of the motor vehicle designed as a pressure sensor to ascertain an evaporative emission control system pressure prevailing in the evaporative emission control system between a filter device of the evaporative emission control system and the canister-purge valve;

using a measurement device of the motor vehicle to ascertain an ambient pressure of the motor vehicle;

using a computational device of the motor vehicle to compute a flow volume of a fluid streaming through the canister-purge valve on the basis of the ascertained evaporative emission control system pressure and the ascertained ambient pressure; and using an engine control device of the drive system of the motor vehicle to operate the drive system taking into account the computed fluid flow volume.

7. The drive system as recited in claim 5, wherein the first sensor is integrated in the canister-purge valve of the evaporative emission control system.

8. The drive system as recited in claim 5, wherein the measurement device is designed as a second sensor, the second sensor being designed as a pressure sensor.

9. The drive system as recited in claim 5, wherein the evaporative emission control system has a third sensor designed as a temperature sensor, the first sensor and the third sensor being designed as a common sensor.

10. A motor vehicle, comprising a drive system, wherein the drive system is designed in accordance with claim 5.

* * * * *